United States Patent [19]

Hanselman et al.

[11] 4,259,115

[45] Mar. 31, 1981

[54] METHOD FOR FORMING SILVER PRECIPITATING NUCLEI

[75] Inventors: Raymond B. Hanselman, Concord; John J. Magenheimer, Wellesley; Kenneth G. Scott, Sherborn, all of Mass.

[73] Assignee: Polaroid Corporation, Cambridge, Mass.

[21] Appl. No.: 108,455

[22] Filed: Dec. 31, 1979

[51] Int. Cl.[3] ..... C23C 3/02

[52] U.S. Cl. ..... 106/1.28; 106/1.05; 106/135; 106/137; 252/313 R; 430/247

[58] Field of Search ..... 106/1.05, 1.11, 135, 106/137, 1.28; 252/313 R; 430/247

[56] References Cited

U.S. PATENT DOCUMENTS

| | | | |
|---|---|---|---|
| 2,698,236 | 12/1954 | Land | 95/8 |
| 2,726,154 | 12/1955 | Land | 430/228 |
| 2,857,274 | 10/1958 | Land et al. | 430/251 |
| 2,861,885 | 11/1958 | Land | 430/229 |
| 2,944,894 | 7/1960 | Land | 96/3 |
| 3,019,124 | 1/1962 | Rogers | 430/207 |
| 3,032,008 | 5/1962 | Land et al. | 425/382 |
| 3,284,208 | 11/1966 | Land | 430/7 |
| 3,536,488 | 10/1970 | Land | 96/24 |
| 3,615,426 | 10/1971 | Debruyn | 40/234 |
| 3,615,427 | 10/1971 | Debruyn | 430/234 |
| 3,615,428 | 10/1971 | Weed | 430/234 |
| 3,615,429 | 10/1971 | Weed | 430/234 |
| 3,615,440 | 10/1971 | Bloom | 430/234 |
| 3,647,440 | 3/1972 | Rasch | 96/29 |
| 3,730,716 | 5/1973 | Land et al. | 430/228 |
| 3,894,871 | 7/1975 | Land | 430/228 |

OTHER PUBLICATIONS

Land, "One Step Photography", *Photographic Journal*, pp. 7–15, Jan. 1950.

*Primary Examiner*—Lorenzo B. Hayes
*Attorney, Agent, or Firm*—Philip G. Kiely

[57] ABSTRACT

Noble metal silver precipitating nuclei are prepared by reducing a noble metal salt or complex in the presence of a polymer with a Sn° suspension formed by the borohydride reduction of a tin salt. The invention is also directed to film units employing said nuclei.

8 Claims, 1 Drawing Figure

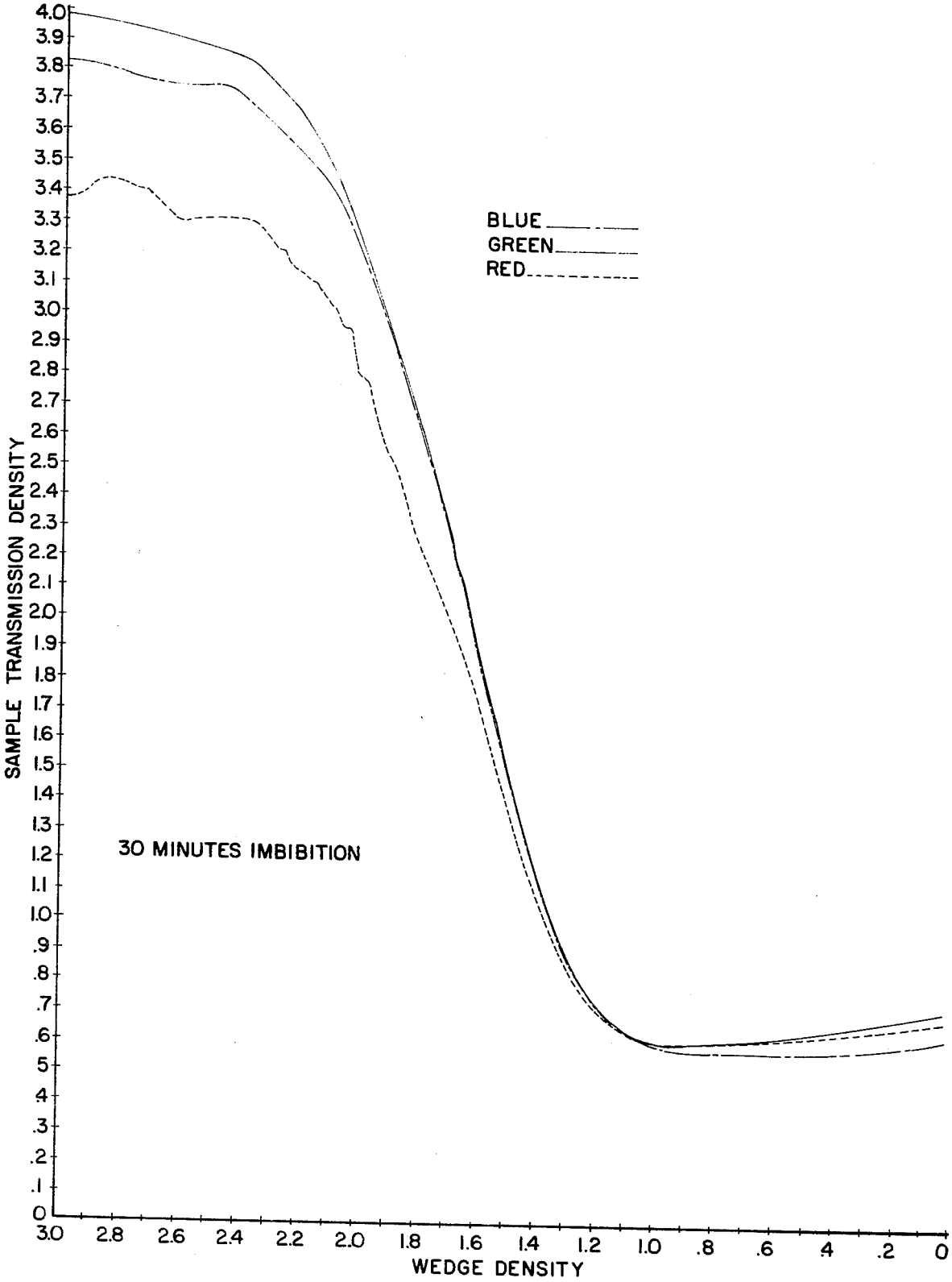
SAMPLE TRANSMISSION DENSITY
4.0
3.9
3.8
3.7
3.6
3.5
3.4
3.3
3.2
3.1
3.0
2.9
2.8
2.7
2.6
2.5
2.4
2.3
2.2
2.1
2.0
1.9
1.8
1.7
1.6
1.5
1.4
1.3
1.2
1.1
1.0
.9
.8
.7
.6
.5
.4
.3
.2
.1
0
BLUE
GREEN
RED
30 MINUTES IMBIBITION
3.0
2.8
2.6
2.4
2.2
2.0
1.8
1.6
1.4
1.2
1.0
.8
.6
.4
.2
0
WEDGE DENSITY

METHOD FOR FORMING SILVER PRECIPITATING NUCLEI

BACKGROUND OF THE INVENTION

Procedures for preparing photographic images in silver by diffusion transfer principles are well known to the art. Thus, a silver diffusion transfer reversal process may provide a positive silver transfer image by development of the latent image provided by exposure of a photosensitive silver halide emulsion and, substantially contemporaneous with such development, a soluble silver complex is obtained, by reaction of a silver halide solvent with unexposed and undeveloped silver halide of the emulsion. The resultant soluble silver complex is, at least in part, transported in the direction of a suitable print-receiving element and the silver of the complex there precipitated to provide the requisite positive silver image formation.

The silver receptive stratum employed may be so constituted as to provide an unusually effective silver precipitating environment which causes the silver deposited therein, in comparison with negative silver developed in the silver halide emulsion, to possess an extraordinarily high covering power, that is, opacity per given mass of reduced silver; see Edwin H. Land, One Step Photography, Photographic Journal, section A, pp. 7–15, January 1950.

Specifically, to provide such environment, silver precipitation nuclei may be disposed within the silver receptive stratum in clusters possessing a diameter directly proportional to the mass of image silver to be deposited in situ by reduction. Such conformation can be employed to cause image silver to precipitate, in association with the silver precipitation nuclei clusters, with the required density and of a size directly related to the physical parameters of the clusters. The image silver thus precipitated in situ in galaxies of chosen physical parameters provides image conformation in which the elemental silver of the print-receiving element may possess a very high order of covering power, for example, five to fifteen or more times that of the negative elemental image silver in the silver halide element.

Additive color reproduction may be produced by exposing a photosensitive silver halide emulsion through an additive color screen having filter media or screen elements each of an individual additive color, such as red, or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

U.S. Pat. No. 3,536,488 is directed to photosensitive silver halide crystals or grains dispersed in an environment containing silver precipitating nuclei or agents which in the presence of a solvent developer composition cause exposed grains to be reduced to opaque structures smaller in presented area than the area of the same grains developed in an identical developer composition absent such precipitating nuclei. Silver image masses derived from exposed silver halide grains developed in accordance with U.S. Pat. No. 3,536,488, accordingly, possess low optical covering power as compared with the covering power provided by identical grains developed in the same solvent developer absent the presence of the precipitating environment. Specifically, the patent provides for the production of a direct positive silver image in which the mass distribution of silver is substantially uniform macroscopically and nonuniform microscopically, and in which the transmissiveness of silver image mass is a function of the quantity of actinic radiation which exposed the photosensitive silver halide. The exposed silver halide grains are reduced, in situ, as compact masses possessing low covering power simultaneously with reduction, in situ, of unexposed silver halide grains as a colloidal dispersion possessing high covering power. The direct positive silver image thus produced in situ possess extraordinary high sharpness when compared with transfer processes in which unexposed silver halide grains are dissolved and transferred to the ultimate image-carrying site. U.S. Pat. No. 3,536,488 is incorporated by reference herein in its entirety.

As set forth in U.S. Pat. No. 2,698,236 the array of silver atoms precipitated in the image-receiving element is influenced by the size of the silver-precipitating nuclei. If the silver precipitating nuclei are relatively small, the silver deposited thereon will be of a corresponding size and, therefore, generally red in color which is undesirable. Clusters or galaxies of silver precipitating nuclei possessing a diameter directly proportional to the mass of individual silver particles to be precipitated therein are disposed in the image-receiving layer to cause silver to precipitate in association with silver-precipitating nuclei clusters with a required density and of a size directly related to the physical parameters of the clusters, thus providing the desired black silver image.

It has also been found that silver precipitating nuclei disposed in a relatively thick layer, i.e., 1 micron or greater, also results in a redder image. While theories can be advanced for this phenomenon, the precise reason is not known.

Noble metal silver precipitating nuclei are known to the art. Copending Application Ser. No. 69,282 filed Aug. 24, 1979 (common assignee) discloses a method of forming such nuclei by the reduction of a noble metal salt or complex. U.S. Pat. No. 3,647,440 also discloses noble metal silver precipitating nuclei obtained by reducing a metal salt in the presence of a protective colloid with a reducing agent having a standard potential more negative than −0.30.

Copending Application Ser. No. 897,944, filed Apr. 4, 1978 (common assignee) now U.S. Pat. No. 4,209,330 is directed to a method of forming clusters of noble metal silver precipitating nuclei. Noble metal nuclei formed by the reduction of noble metal salts or complexes in colloidal suspension are formed into clusters by causing an instability in the colloid, e.g., by adjusting the pH of the colloidal solution to at least about 2.6. If desired, the clusters may be employed at this point either by suitable separation techniques or by the addition of a bulking polymer to the colloid to impart stability to the clusters. If a separation technique is employed, the clusters may be allowed to floc, whereupon separation of the floc may be carried out by filtering and the like, and then redispersing the flocced particles in a suitable polymer binder with, preferably, sonification, and coating the thus-formed polymer/cluster mixture which may be coated on a support to provide an image-receiving element.

Such a method presents scale-up problems, and, in addition, the nuclei so produced must be used relatively soon after preparation to insure sensitometric uniformity in a product employing the nuclei.

A novel method for producing noble metal silver precipitating nuclei has now been found, which nuclei are particularly suited for use in the same layer as the photosensitive silver halide grains.

SUMMARY OF THE INVENTION

The present invention is directed to a method for forming noble metal silver precipitating nuclei by reducing a noble metal salt or complex in the presence of a polymer with a Sn° suspension formed by the borohydride reduction of a tin salt. The invention is also directed to film units employing said nuclei.

BRIEF DESCRIPTION OF THE DRAWINGS

The FIGURE is a characteristic curve of a film unit of the present invention.

DETAILED DESCRIPTION OF THE INVENTION

As stated above, a problem often encountered in the formation of noble metal silver precipitating nuclei involves the particle size of the nuclei formed as a result of the reduction of the noble metal salt or complex. For ease of manufacturing and uniformity of the product, it is preferred to form nuclei of the desired size during the reduction step without an additional operation to form the desired clusters.

The novel method of the present invention involves the reduction of noble metal salts or complexes by a suspension formed by the borohydride reduction of tin salts; more specifically, the reducing agent is formed by the reduction in an aqueous acidic medium of a tin salt by alkali metal borohydride. While not intending to be bound by theory, it is believed that a species of Sn° is formed that functions as the reducing agent for the noble metal salt or complex.

Any suitable water-soluble tin salt which is reducible by borohydride may be employed. As examples of such tin salts mention may be made of stannous chloride, stannous bromide, stannous fluoride, stannous acetate and stannic chloride.

In a particularly preferred embodiment, a formate reducing agent, such as sodium formate, is used as an additional reducing agent in combination with the Sn° reducing agent.

By means of the present invention, nuclei clusters of about 10–50 nm are formed as a relatively stable colloid. Nuclei formed by the procedure of the present invention are particularly suitable for use in film units wherein nuclei are disposed in the same layer as the photosensitive silver halide grains as well as in receiving layers which do not include silver halide grains.

The noble metals employed in the present invention include gold, palladium and platinum. Particularly superior results are achieved with palladium. For convenience, the invention will be described primarily in terms of this preferred embodiment.

Combinations of noble metals may be used as well as single noble metals. In a preferred embodiment, noble metal salts or complexes may be reacted with the above-described Sn° reducing agent to provide the desired noble metal nuclei. Suitable compounds include the following:

$K_2PdCl_4$
$PdCl_2$
$H_2PtCl_6$
$AgNO_3$
$HAuCl_4$

The presence of the polymer during nuclei preparation is to maintain the noble metal nuclei in colloidal suspension and sufficient polymer is employed to prevent precipitation. Such polymers employed in nuclei preparation are known to the art. The silver precipitating layer employing the nuclei of the present invention may contain other polymers in addition to the one employed in nuclei formation. Such polymers are known to the art and include hydroxyethyl cellulose and polyvinyl hydrogen phthalate.

The borohydride reducing agent is employed in a quantity which provides for the substantially complete reduction of the tin salt, which is preferably stannous chloride.

It should be noted that the compound used to reduce the tin salt is critical. For example, while sodium hypophosphite, ascorbic acid and a variety of primary and secondary alcohols, e.g., ethanol, will reduce palladous salts to Pd° they will not reduce tin salts. Further, titanium (III) chloride will reduce tin salts to Sn°, however, such a reduction is not suitable for the present invention since the Sn° plated out on the walls of the reaction vessel rather than remaining in suspension.

If the Sn° suspension is used alone to reduce the noble metal compound, noble metal nuclei are formed; however, it may be difficult to control the growth of the noble metal nuclei clusters.

If sodium formate is used alone to reduce the noble metal compound, extremely fine noble metal nuclei are formed which are not suitable for use.

The combination of the formate and Sn° reducing agent provides noble metal nuclei of the desired particle size and as a stable colloid. The function of the formate is not known for certain. While not intending to be bound by theory, it is believed that the formate may function to maintain a reducing environment by preventing the formation of $Sn^{+4}$ which will not reduce the noble metal compounds or it may function as an additional reducing agent for the noble metal compound. It is believed, however, that $Sn^{+4}$ does not form in the presence of formate.

The silver precipitating layer employing the nuclei of the present invention may contain other polymers in addition to the one employed in nuclei formation. Such polymers are known to the art and include hydroxyethyl cellulose and polyvinyl hydrogen phthalate.

EXAMPLE A (Nuclei preparation)

The following solutions were prepared:

| | | |
|---|---|---|
| Solution A - 40° C. | | |
| Water | 20 | g |
| Sodium formate | 3.78 | g |
| Gelatin (10%) | 18.75 | g |
| Solution B | | |
| Water | 15 | g |
| Sodium borohydride | 0.63 | g |
| Potassium hydroxide | 1.88 | g |
| Solution C | | |
| Water (40° C.) | 255 | g |
| Polymerized sodium salts of | 3.75 | g |

-continued

| | | |
|---|---|---|
| alkyl naphthalene sulfonic acid (Sold by W.R. Grace & Co. N.Y., N.Y. under the trade name Daxad 11) (10% solution) | | |
| Stannous chloride dihydrate | 3.75 | g |

Two minutes after the preparation of Solution C, Solution B was added to Solution C with vigorous stirring. A dark grey suspension of Sn° was formed accompanied by hydrogen gas evolution. One minute after combining of Solutions B & C, Solution A was added. A fourth solution

| Solution D | | |
|---|---|---|
| Water (95° C.) | 1095.5 | g |
| Glacial acetic acid | 11.25 | g |
| Gelatin | 18.75 | g |
| Palladous chloride (8.51% $PdCl_2$, 2.15% HCl) | 50 | g |

was then prepared and one minute after the combining of Solutions A, B and C, the combined solution was added to the palladous chloride solution (solution D). Nuclei formation was immediately observed. The mix was stirred at 95° C. for 20 min. and then cooled to 30° C. The thus-formed nuclei mix was passed through a silk screen and then dialyzed through a Cordis-Dow Model #5 Artificial Kidney to a final pH of 3.6–3.9 and a conductivity of about 100 $\mu$ mhos/cm$^2$. 1500 g of dialyzed nuclei at room temperature were then combined with 397.5 g of melted gelatin (24%) and the mixture was stirred until completely dissolved at 40° C. The nuclei can be used immediately or stored under refrigeration for future use.

EXAMPLE I

A film unit was prepared comprising a transparent polyester film base carrying on one surface an additive color screen of appromimately 1500 triplets per inch of red, blue and green filter screen elements in repetitive side by side relatonship; 328 mgs/ft$^2$ of polyvinylidene chloride protective overcoat layer; an emulsion/silver precipitation layer prepared in the following matter;

The following ingredients were combined in order as listed at 40° C.

59.28 g 5% propylene glycol alginate
162.1 g nuclei mix prepared from the procedure of Example A
99.5 g distiled water
35.08 g of 24% gelatin
50.6 g of 25% carboxylated styrene/butadiene copolymer
latex (Dow-620, Dow Chemical Company, Midland, Michigan)

The thus-formed premix was then filtered through a 10 $\mu$ Cox filter under nitrogen pressure and 343.6 g of the filtered premix were combined with 234 g of a panchromatically sensitized silver iodobromide emulsion having a grain size of about 0.72$\mu$ with a 0.827 gel to silver ratio. The thus-formed emulsion mix was coated over the above-identified protective overcoat layer at a coverage of 150 mgs/ft$^2$ of silver and 1.31 mgs/ft$^2$ of nuclei. Panchromatic sensitization was provided with 5,5'-dimethyl-9-ethyl-3,3'-bis-(3-sulfopropyl) thiacarbocyanine-triethyl-ammonium salt (0.53 mg/g Ag); 5,5'-diphenyl-9-ethyl-3,3'-bis-(4-sulfobutyl) oxacarbocyanine (1.0 mg/g Ag); anhydro 5,6-dichloro-1, 3-diethyl-3'-(4''-sulfobutyl)-benzimidazolothiacarbocyanine hydroxide (1.0 mg/g Ag); and 3-(3-sulfopropyl)-3'-ethyl4,5-benzothia-thiacyanine betaine (1.25 mg/g Ag); red, green, green and blue sensitizers respectively.

The following top coat was provided over the emulsion layer.

| Top Coat | mgs/ft$^2$ |
|---|---|
| Gelatin | 341 |
| Dow 620 (carboxylated styrene/butadiene copolymer latex Dow Chemical Co., Midland, Michigan) | 175 |
| Propylene glycol alginate | 25.7 |
| Dioctyl ester of sodium sulfosuccinate | 1.2 |
| $Au^{+1}$ complex of methylthioglycolate | 10 (as gold) |
| Pyridinium bis-1,5 (1,3-diethyl-2-thiol-5-barbituric acid) pentamethine oxanol (silver complex) | 5.6 |

The film units prepared according to the above procedure were given a 16 mcs exposure with a Xenon sensitometer and processed with mechanical rollers at a 0.0012 in. gap disposing the below indicated processing composition between the top coat and a polyethylene terephthalate cover sheet.

| Processing Composition | Wt. % |
|---|---|
| Sodium hydroxide | 8.4 |
| Hydroxyethyl cellulose (sold by Hercules, Inc., Wilmington, Delaware under the tradename Natrosol 250 HH) | 0.6 |
| Tetramethyl reductic acid | 7.0 |
| Potassium bromide | 0.6 |
| Sodium sulfite | 0.8 |
| 2-methylthiomethyl-4,6-dihydroxypyrimidine | 7.0 |
| 4-aminopyrazolo-[3,4d]-pyrimidine | 0.02 |
| N-benzyl-2-methylpyridinium bromide (50% solution) | 3.5 |
| Water | 66.6 |
| $Na_2B_4O_7 \cdot 10H_2O$ | 3.3 |
| Glycerine | 1.7 |
| p-isononyl phenoxy polyglycidol (containing about 10 glycidol units) | 0.5 |

The film units were then held in the dark for 30 minutes and the cover sheets were then removed, retaining the rest of the film unit together, and air drying. The spectral data shown in the attached figure were obtained by reading the neutral column to red, green and blue light in an automatically recording densitometer. The figure shows high $D_{max}$ and good speed and the image is reasonably neutral except for a slightly warm shoulder area.

While the invention was described primarily in terms of an additive color system, it should be understood that the noble metal nuclei prepared according to the procedure of the present invention are also suitable for use in black and white silver diffusion transfer systems.

The support employed in the present invention is not critical. The support or film base employed may comprise any of the various types of transparent rigid or flexible supports, for example, glass polymeric films of both the synthetic type and those derived from naturally occuring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric fils derived from ethylene glycol terephthalic acid; polymer cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulates, or the silver halide solvent may be a cyclic imide, such as uracil, in combination with a nitrogenous base as taught in U.S. Pat. No. 2,857,274 issued Oct. 21, 1958 to Edwin H. Land or pseudouracils, such as the 4.6-dihydroxy-pyrimidines. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processng composition. The processing composition may be left on the processed film or removed, in accordance with known techniques, as is most appropriate for the particular film use. The requisite alkalinity e.g., a pH of 12–14, is preferably imparted to the processing composition, by materials such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para-or ortho-positions with respect to each other, such as hydroquinone, tert-butyl hydroquinone, toluhydroquinone, p-aminophenol, 2,6-dimethyl-4-aminophenol, 2,4, 6-triaminophenol, etc. If the additive color transparency is one which is not washed after processing to remove unused silver halide developing agent, development reaction products, etc., The silver halide developing agent (s) should not give rise to colored reaction products which might stain the image or which, either unreacted or reacted, might adversely affect the stability and sensitometric properties of the final image. Particularly useful silver halide developing agents having good stability in alkaline solution are substituted reductive acids, particularly tetramethyl reductic acid, as disclosed in U.S. Pat. No. 3,615,440 issued Oct. 26, 1971 to Stanley M. Bloom and Richard D. Cramer, and $\alpha$-$\beta$-enediols as disclosed in U.S. Pat. No. 3,730,716 issued to Edwin H. Land, Stanley M. Bloom and Leonard C. Farney on May 1, 1973.

What is claimed is:

1. A method for forming noble metal silver precipitating nuclei which comprises reducing a noble metal salt or complex in the presence of a polymer with an aqueous suspension of metallic tin produced by the reduction of a tin salt with borohydride.

2. The method of claim 1 wherein said reduction of a noble metal salt or complex is carried out in an aqueous solution.

3. The method of claim 1 wherein said polymer is gelatin.

4. The method of claim 1 wherein said reduction of a noble metal salt or complex also includes a formate reducing agent.

5. The method of claim 4 wherein said formate is sodium formate.

6. The method of claim 1 wherein said tin suspension is formed by the reduction of a stannous salt with an alkali metal borohydride.

7. The method of claim 1 wherein said noble metal is palladium.

8. The method of claim 1 which includes the further step of dialyzng subsequent to said reduction of a noble metal salt or complex.

* * * * *